US005483213A

United States Patent [19]

Mueller et al.

[11] Patent Number: 5,483,213

[45] Date of Patent: Jan. 9, 1996

[54] TERMINAL BLOCK WITH TERMINAL-LOCKING SLOT

[75] Inventors: Robert W. Mueller, Imperial; Arthur D. Carothers, Beaver Falls, both of Pa.

[73] Assignee: Eaton Corporation, Cleveland, Ohio

[21] Appl. No.: 250,123

[22] Filed: May 27, 1994

[51] Int. Cl.[6] ..... H01N 67/02

[52] U.S. Cl. ..... 335/132; 335/202

[58] Field of Search ..... 335/132, 133, 335/8–10, 202; 200/293, 305

[56] References Cited

U.S. PATENT DOCUMENTS

| | | | |
|---|---|---|---|
| 3,812,400 | 5/1974 | Gryctko et al. | 335/202 |
| 4,539,541 | 9/1985 | Bharteey et al. | 335/132 |
| 4,595,812 | 6/1986 | Tamaru et al. | 335/132 |

OTHER PUBLICATIONS

Installation Instructions for Auxiliary Switch for EHD, FDB, FD, HFD, FDC, FW, HFW, FWC Circuit Breakers, Molded Case Switches, and F–Frame Motor Circuit Protectors (MCP), pp. 1–4, Jul. 1990, Westinghouse I.L. 29C120–A.

*Primary Examiner*—Lincoln Donovan
*Attorney, Agent, or Firm*—Martin J. Moran

[57] ABSTRACT

An auxiliary terminal block for an electrical switching device includes a molded block and at least one terminal for terminating the internal wiring and external wiring of the switching device. The molded block has a first wiring channel for the external wiring, a second wiring channel for the internal wiring, and a partial partition between the two wiring channels. The partition has a slot for engaging and locking the terminal after the internal wiring has been terminated. The partition may include two walls having a generally constant width therebetween. Shoulders or tabs may be disposed on each of the walls for engaging and locking the terminal to the block. Alternatively, the partition may include two walls which are at least partially resilient and which form a generally V-shaped opening between the two wiring channels. A shoulder may be disposed on each of the walls for engaging and locking the terminal to the block whenever the terminal is fully inserted within the partition. The terminal may have an L-shape, a first arm which terminates the external wiring, and a second arm having a crimp terminal or solder terminal for terminating the internal wiring. The first arm may have on opposite sides thereof two notches mating with the two walls. The two notches of the first arm form a neck which is generally freely insertable within the V-shaped opening and which is generally resisted by further insertion within the V-shaped opening until the neck is fully inserted and confined within an opening adjacent the shoulders.

20 Claims, 5 Drawing Sheets

TERMINAL BLOCK WITH TERMINAL-LOCKING SLOT

BACKGROUND OF THE INVENTION

1. Field of the Invention

This invention relates to a terminal block for an electrical switching device, and more particularly to an auxiliary terminal block having at least one terminal which locks within a slot of the auxiliary terminal block and terminates the auxiliary wiring of a circuit breaker.

2. Background of Information

Electrical switching devices include, for example, circuit switching devices and circuit breakers. Circuit breakers are generally used to protect electrical circuitry from damage due to an overcurrent condition, such as an overload fault or a relatively high level short circuit condition. Molded case circuit breakers, for example, include at least one pair of separable contacts which may be operated either manually by way of a handle disposed on the outside of the case or automatically in response to an overcurrent condition. In the automatic mode of operation, an electronic trip unit, for example, controls an operating mechanism which opens the separable contacts. In the manual mode of operation, the handle, for example, cooperates with the operating mechanism in order to open the separable contacts.

Electrical switching devices have a line terminal for connection to a power source and a load terminal for connection to a load, such as a motor. The separable contacts of the electrical switching device are internally connected to the line and load terminals. Electrical switching devices may also have one or more auxiliary terminals. In a circuit breaker, for example, such auxiliary terminals may be utilized as inputs to provide an external signal for tripping the circuit breaker. Furthermore, other such auxiliary terminals may be utilized as outputs to externally indicate the trip status of the circuit breaker.

Input auxiliary terminals may include, for example, connections to a shunt trip mechanism or an undervoltage trip relay which trips the circuit breaker whenever the line voltage fall below a predetermined value. An external three-position auxiliary terminal block is utilized to provide two terminals for interconnection of the circuit breaker with such external trip mechanisms. Output auxiliary terminals may include, for example, connections to a bell alarm and other external circuits for enunciating or monitoring the open/closed/tripped status of the circuit breaker. An external three-position auxiliary terminal block is utilized to provide three terminals for interconnection of two circuit breaker status relay contacts having a common reference node with such external status monitoring circuits. Combinations of input and output auxiliary terminals may be provided by auxiliary terminal blocks having plural (e.g., six, nine, etc.) terminals.

Existing auxiliary terminal blocks for circuit breakers include a molded block having a first recess for terminating an external wire to the circuit breaker, a second recess for terminating an internal wire of the circuit breaker, and a partition which substantially separates the first and second recesses. The partition has a rectangular opening which interconnects the first and second recesses.

A generally square terminal having a tapped hole rests in the first recess. The tapped hole accepts a screw terminal assembly which terminates the external wiring. The bottom of the first recess has a recessed hole which accommodates the screw terminal assembly. The square terminal also has a rectangular solder tab attached to one side of the terminal for terminating the internal wire of the circuit breaker. The solder tab protrudes through the rectangular opening of the partition and enters the second recess. The solder tab has a hole which may be centered within the second recess. The bottom of the second recess of the existing auxiliary terminal block is generally open. The internal wire of the circuit breaker is inserted through the top of the second recess and through the hole of the solder tab. The internal wire is soldered to the bottom of the solder tab which is accessed through the open bottom of the second recess.

The terminal block further has two upper removable covers for covering the two recesses at the top of the block. Similarly, the terminal block also has a lower removable cover for covering, at the bottom of the block, the hole of the bottom of the first recess and the open bottom of the second recess.

Although the existing terminal block provides a functional design, there is room for improvement. Accessibility of the solder tab within the open bottom of the second recess is limited. This limited accessibility hinders the quality of the resulting solder connection between the internal wire of the circuit breaker and the solder tab. The limited accessibility also increases the time associated with manufacturing the auxiliary terminal block.

There is a need, therefore, for an auxiliary terminal block for a circuit breaker which improves the accessibility of the termination for the internal wiring of the circuit breaker.

There is a more particular need for such an auxiliary terminal block which maximizes the quality of the connection between the internal wiring of the circuit breaker and the termination.

There is another more particular need for such an auxiliary terminal block which eliminates the requirement of a solder connection between the internal wiring of the circuit breaker and the termination.

There is yet another more particular need for such an auxiliary terminal block which maximizes the quality of a solder connection between the internal wiring of the circuit breaker and the termination.

There is another need for an auxiliary terminal block for a circuit breaker which decreases the manufacturing time required to assemble the auxiliary terminal block.

There is still another need for an auxiliary terminal block for a circuit breaker which permits the termination to be assembled outside of the auxiliary terminal block.

SUMMARY OF THE INVENTION

These and other needs are satisfied by the invention which is directed to an auxiliary terminal block for an electrical switching device having internal wiring and accepting external wiring. The auxiliary terminal block comprises a molded block and at least one terminal. The molded block includes, for each of at least one wiring termination, a first wiring channel for accepting the external wiring, a second wiring channel for the internal wiring, and a partition for partially separating the first wiring channel and the second wiring channel. Each terminal, which interconnects the external wiring with the internal wiring, includes a termination for the external wiring within the first wiring channel and a termination for the internal wiring within the second wiring channel. The partition has a slot for engaging the terminal after the internal wiring has been terminated to its termination. The partition may also lock the terminal to the block.

The partition includes a first wall and a second wall. The two walls may have a generally constant width therebetween. A shoulder may be formed on each of the two walls for engaging and locking the terminal to the block. Each shoulder may have one or more resilient tabs which are generally perpendicular with respect to the two walls. Alternatively, each tab may be generally oblique with respect to the walls.

Alternatively, the two walls may be at least partially resilient and may form a generally V-shaped opening between the first wiring channel and the second wiring channel. The V-shaped opening may have a first end having a width and a second end having a width which is smaller than the width of the first end. A shoulder may be formed on each of the two walls for engaging and locking the terminal to the block. An opening for the terminal may be formed adjacent the shoulders and may have a width which is larger than the width of the second end of the V-shaped opening.

The terminal may have a general L-shape. A first arm of the L-shaped terminal rests in the first wiring channel. The first arm may have on opposite sides thereof a first notch which mates with the first wall and a second notch which mates with the second wall. The two walls, the generally V-shaped opening and the two notches of the first arm may be oriented in a common plane in order to insert the terminal into the partition of the block.

The tabs may lock the terminal to the block whenever the first arm is fully inserted within the slot of the partition. Alternatively, the shoulders lock the terminal whenever the first arm is fully inserted within the opening for the terminal adjacent the shoulders. The two notches of the first arm form a neck having a width which is generally smaller than the width of the first end of the V-shaped opening, larger than the width of the second end of the V-shaped opening, and less than or equal to the width of the opening for the terminal adjacent the shoulders. The terminal is generally freely insertable within the first end of the V-shaped opening. The terminal is generally resisted by further insertion of the terminal within the V-shaped opening which has progressively smaller widths between the first end and the second end. Finally, the terminal is confined within the opening for the terminal adjacent the shoulders.

The first arm of the terminal for the first wiring channel has a tapped hole. A screw terminal may be threadably attached to the tapped hole for terminating the external wiring. The L-shaped terminal may also include a second arm for the second wiring channel. The second arm of the terminal for the second wiring channel may have a crimp terminal, or alternatively a solder terminal, for terminating the internal wiring.

The terminal block may have two arms for attachment to the electrical switching device. The terminal block may also have two removable covers for coveting the first wiring channel and the second wiring channel at the top of the block.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
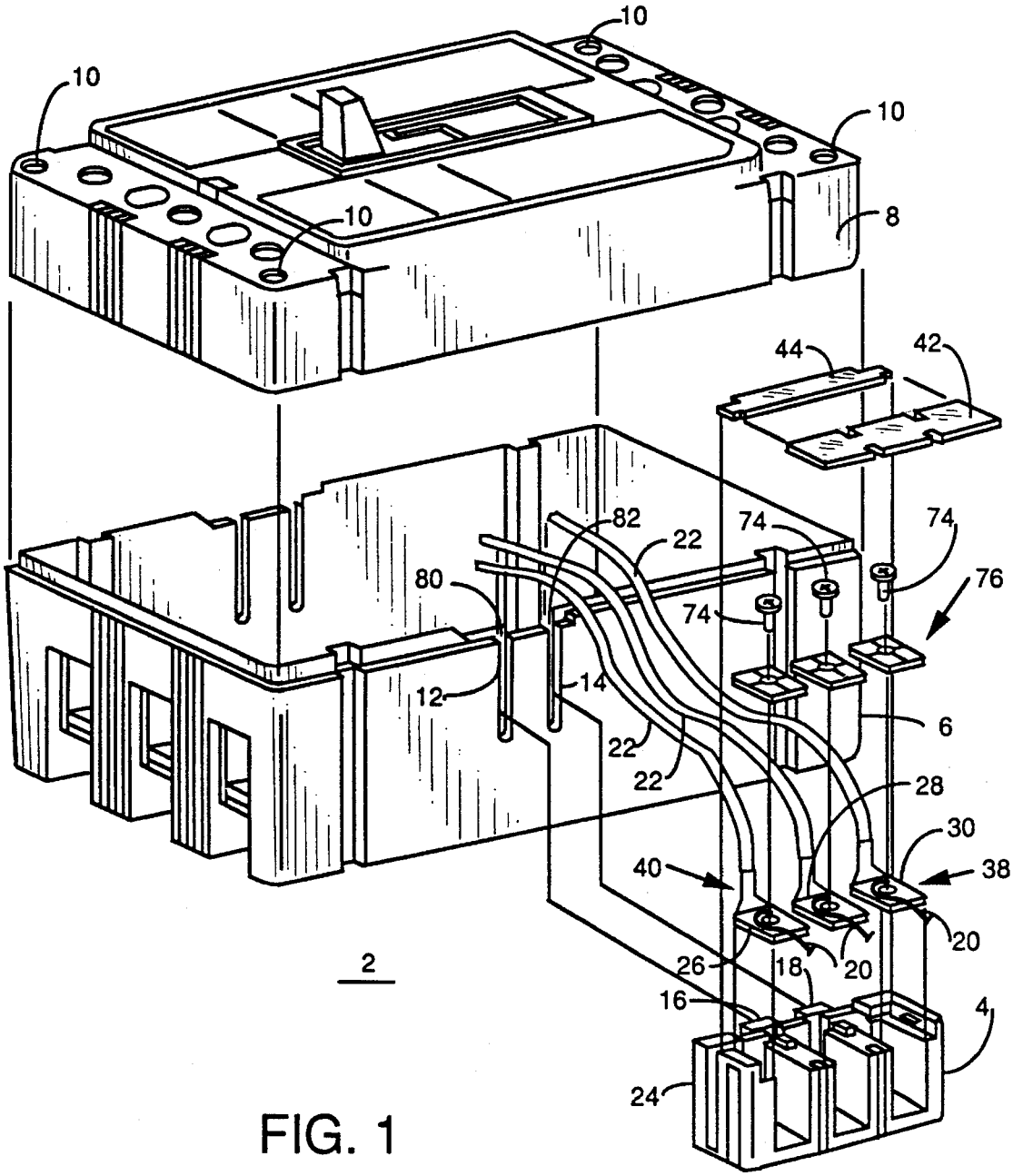
FIG. 1 is an exploded isometric view of a circuit breaker having an auxiliary terminal block in accordance with the invention.

FIG. 1 is an exploded isometric view of an electrical switching device, such as the exemplary circuit breaker 2, which has an auxiliary terminal block 4, it being understood that the present invention is applicable to a wide variety of electrical applications, such as electromagnetic switching devices, circuit switching devices, and vacuum, air gap and insulating gas contactors or motor starters. The circuit breaker 2 includes a molded base 6, a molded cover 8, and a plurality of fasteners 10 which fasten the cover 8 to the base 6. The base 6 has two grooves 12,14 for attaching the auxiliary terminal block 4 to the circuit breaker 2. The exemplary auxiliary terminal block 4 includes two T-shaped arms 16,18 which are inserted in the two grooves 12,14, respectively, of the base 6 of the circuit breaker 2. Whenever the cover 8 is fastened to the base 6, the terminal block 4 is securely attached to the circuit breaker 2.

The exemplary circuit breaker 2 accepts a plurality of external wires 20 and has a plurality of corresponding internal wires 22. The exemplary auxiliary terminal block 4 includes an exemplary molded plastic block 24 and three terminals 26,28,30, it being understood that the present invention is also applicable to terminal blocks having six, nine, or any number of terminals.

Figure 2:
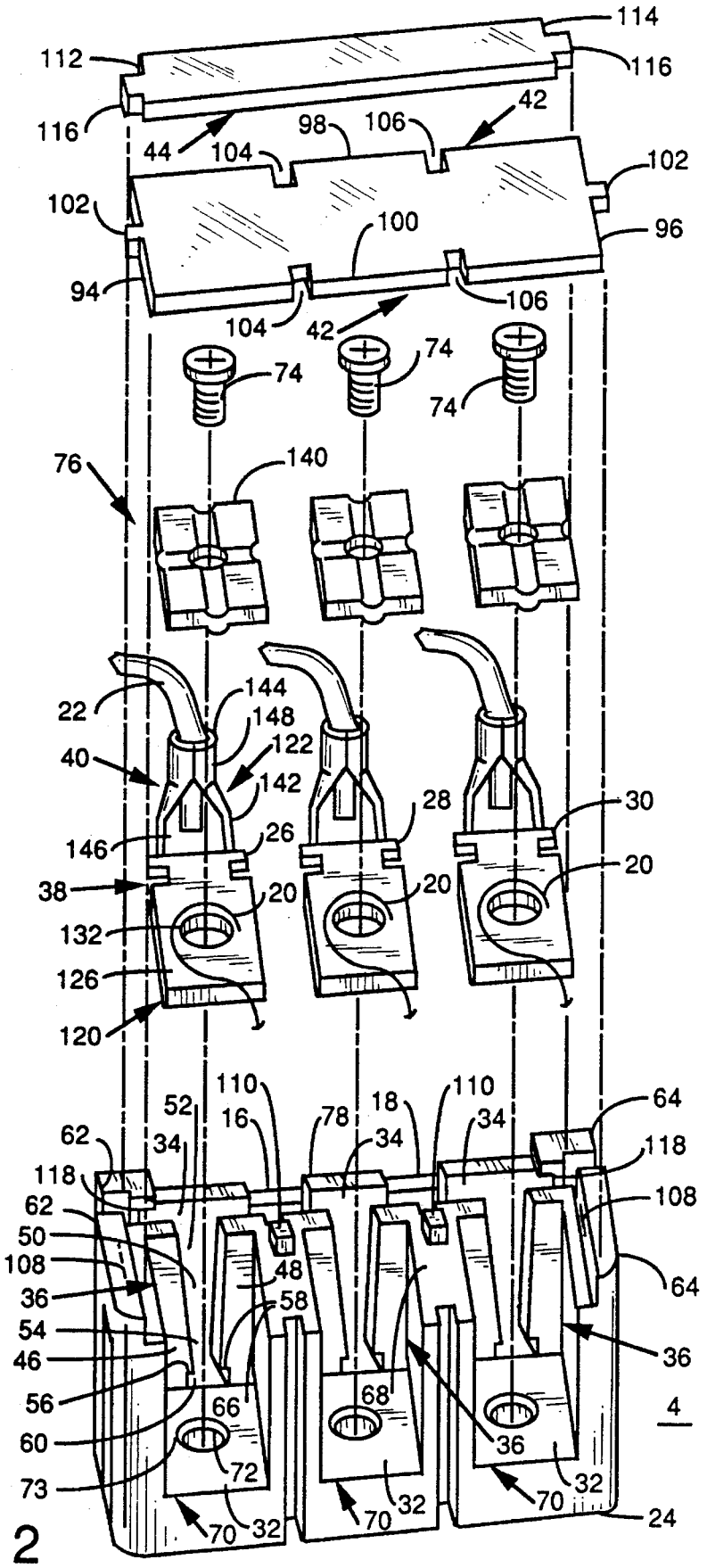
FIG. 2 is an exploded isometric view of a terminal block in accordance with the invention.

Referring now to FIGS. 1 and 2, for each of the three terminals 26,28,30, the block 24 includes a first wiring channel 32 for accepting a corresponding external wire 20, a second wiring channel 34 for a corresponding internal wire 22, and a partition 36 for partially separating the first wiring channel 32 and the second wiring channel 34. Each of the terminals 26,28,30, which electrically interconnect a corresponding one of the external wires 20 with a corresponding one of the internal wires 22, includes a termination 38 for the corresponding external wire 20 within the first wiring channel 32 and a termination 40 for the corresponding internal wire 22 within the second wiring channel 34. As described in more detail below, the terminal block 4 also includes a removable plastic cover 42 for covering the three wiring channels 32 and a removable plastic cover 44 for covering the three wiring channels 34.

Continuing to refer to FIG. 2, an exploded isometric view of the exemplary auxiliary terminal block 4 is illustrated. Each of the partitions 36 for the terminals 26,28,30 has two walls 46,48 which form a generally V-shaped slot or opening 50 between the first wiring channel 32 and the second wiring channel 34. The V-shaped opening 50 has an upper end 52 and a lower end 54. The upper end 52 has a width which is wider than a width of the lower end 54.

Two shoulders 56,58 are respectively formed on the walls 46,48 at the lower end 54 of the V-shaped opening 50. As described in greater detail below, the shoulders 56,58 engage and lock a corresponding one of the terminals 26,28,30 to the block 24. Each of the partitions 36 also has a rectangular opening 60 adjacent the shoulders 56,58 at the lower end 54 of the V-shaped opening 50. The width of the rectangular opening 60 is wider than the width of the lower end 54 and the width between the shoulders 56,58, in order to confine and lock the corresponding one of the terminals 26,28,30 to the block 24.

The block 24 includes three of the first wiring channels 32 for accepting the external wires 20. The three wiring channels 32 are formed by two sides 62,64 and by two barriers 66,68 of the block 24. Each of the wiring channels 32 has an open face 70 for accepting an external wire 20 and a partition 36 which partially opens to a corresponding one of the second wiring channels 34. As described in more detail below, each of the wiring channels 32 also has a recessed hole 72 within a recess 73 for accommodating a screw 74 of a screw terminal assembly 76.

The block 24 also includes three of the second wiring channels 34 for the internal wires 22. The wiring channels 34 are formed by the two sides 62,64 and by the two barriers 66,68 of the block 24. Each of the wiring channels 34 is partially enclosed by a partition 36, which partially opens to a corresponding one of the first wiring channels 32, and by a rear side 78 of the block 24. The rear side 78 includes two vertical wiring apertures 84,86 (see FIG. 4) on the upper half of the block 24 behind the two barriers 66,68, respectively. The two barriers 66,68 also include two vertical wiring apertures 88,90 (see FIG. 4), respectively. The internal wires 22 of the circuit breaker 2 are routed through one of the two wiring apertures 80,82 of the circuit breaker 2 (see FIG. 1). Then, the internal wires 22 are routed through one of the wiring apertures 84,86 and through one of the wiring apertures 88,90, in order to enter a corresponding one of the second wiring channels 34.

The generally rectangular plastic cover 42 covers the top of the three wiring channels 32. The cover 42 has two ends 94,96 and two sides 98,100. Each of the ends 94,96 of the cover 42 has a mounting tab 102 and each of the sides 98,100 of the cover 42 has two mountings slots 104,106. Each of the sides 62,64 of the block 24 has a mounting slot 108 for a corresponding one of the mounting tabs 102 and each of the barriers 66,68 has a mounting tab 110 for a corresponding one of the mounting slots 104,106. One of the mounting tabs 102 of the cover 42 is first inserted in either of the mounting slots 108. Then, the cover 42 is flexed and the other one of the mounting tabs 102 is inserted in the other one of the mounting slots 108. Accordingly, except for the open faces 70, the terminations 38 for the external wires 20 are generally enclosed within the terminal block 4.

The generally rectangular plastic cover 44 covers the top of the three wiring channels 34. The cover 44 has two ends 112, 114. Each of the ends 112, 114 of the cover 44 has a mounting tab 116 and each of the sides 62,64 of the block 24 has a mounting slot 118 for a corresponding one of the mounting tabs 116. One of the mounting tabs 116 of the cover 44 is first inserted in either of the mounting slots 118. Then, the cover 44 is flexed and the other one of the mounting tabs 116 is inserted in the other one of the mounting slots 118. Therefore, the terminations 40 for the internal wires 22 are generally enclosed within the terminal block 4.

Figure 3:
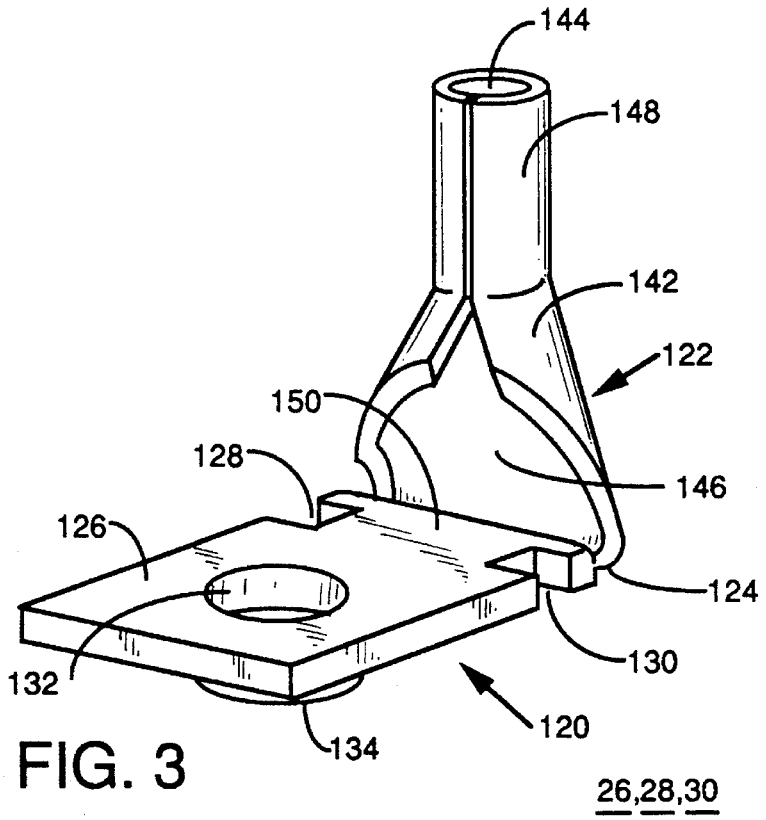
FIG. 3 is an isometric view of a locking terminal in accordance with the invention.
Figure 4:
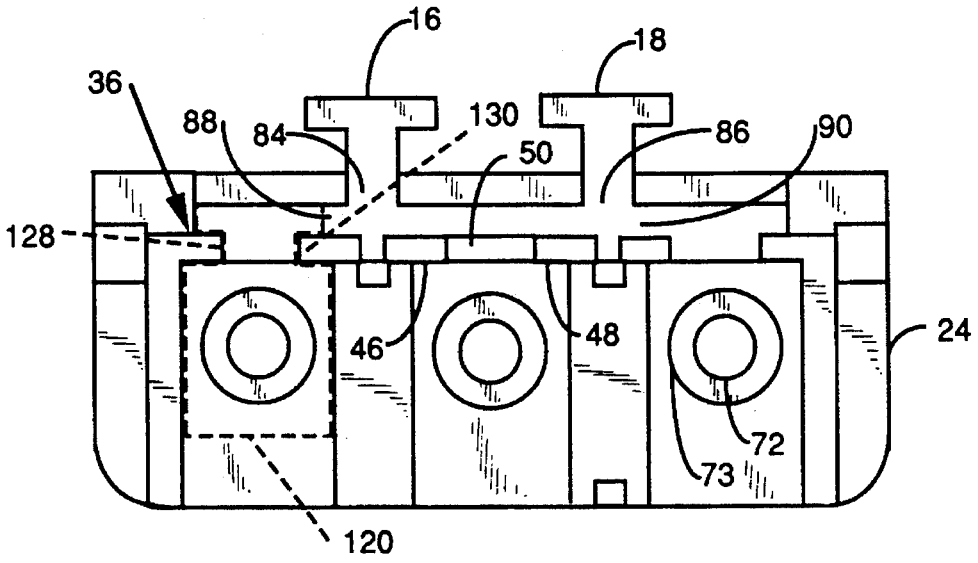
FIG. 4 is a top view of a block for a terminal block.

FIG. 3 is an isometric view of one of the terminals 26,28,30 for use with the block 24 of FIGS. 1 and 2. Each of generally L-shaped terminals 26,28,30 has a first arm 120 and a second arm 122. The two arms 120,122 are interconnected at a bend 124 in order to electrically connect an external wire 20 (see FIG. 1) with a corresponding one of the internal wires 22 (see FIG. 1). As shown in FIGS. 2 and 3, the first arm 120 has a generally square terminal 126 which rests in the first wiring channel 32. The first arm 120 also has on opposite sides thereof two notches 128,130 which mate with the walls 46,48, respectively, of a corresponding one of the partitions 36. As shown in FIG. 4, the two walls 46,48, the V-shaped opening 50, and the two notches 128,130 of the first arm 120 (shown in shadow) are oriented in a common plane whenever one of the terminals 26,28,30 is inserted into a corresponding one of the partitions 36.

Continuing to refer to FIG. 3, the square terminal 126 of the first arm 120 has a centrally located tapped hole 132 which corresponds to one of the recessed holes 72 of FIG. 2. The square terminal 126 of the first arm 120 also has a dimple 134 located on the bottom thereof which rests within one of the recesses 73 of Figure 2. As shown in FIG. 2, the screw 74 of the screw terminal assembly 76 is threadably attached to the tapped hole 132 for terminating a corresponding one of the external wires 20. The recessed hole 72 accommodates the screw 74 which compresses a locking terminal 140. In turn, the locking terminal 140 compresses the external wire 20 upon the square terminal 126 of the first arm 120.

Referring to FIGS. 2 and 3, the second arm 122 of each of the L-shaped terminals 26,28,30 is generally enclosed within a corresponding one of the second wiring channels 34. The second arm 122 is bent in order to form the termination 40, such as the exemplary inverted-funnel 142, for terminating a corresponding one of the internal wires 22. Before each of the terminals 26,28,30 is inserted in the block 24, an end of the internal wire 22 is inserted through an end 144 of the inverted-funnel 142. In turn, the wire 22 is soldered at a mouth 146 of the inverted-funnel 142, or preferably, the wire 22 is crimped at a tubular portion 148 of the inverted-funnel 142.

As described in greater detail below, one of the internal wires 22 is first terminated to a corresponding one of the terminations 40 for such wire 22. Then, the corresponding one of the terminals 26,28,30 is inserted in the block 24. Next, the V-shaped opening 50 of the corresponding partition 36 engages such terminal 26,28,30. Finally, the shoulders 56,58 of the opening 50 lock the corresponding terminal 26,28,30 to the block Referring now to FIGS. 2, 3 and 4, each of the L-shaped terminals 26,28,30 is inserted into a corresponding pair of the first wiring channels 32 and the second wiring channels 34. The notches 128,130 are aligned with the walls 46,48, respectively, of a corresponding one of the partitions 36. These notches 128,130 form a neck 150. The width of the neck 150 is generally smaller than the width of the upper end 52 of the V-shaped opening 50. In this manner, each of the terminals 26,28,30 is generally freely insertable within the upper end 52 of the V-shaped opening 50. In contrast, the width of the neck 150 is larger than the width of the lower end 54 of the V-shaped opening 50. Similarly, the width of the neck 150 is also larger than the width between the shoulders 56,58. Accordingly, further insertion of each of the terminals 26,28,30 is generally resisted by the corresponding V-shaped opening 50 which has progressively smaller widths between the upper end 52 and the lower end 54.

The walls 46,48 of the molded plastic block 24 are partially resilient. In this manner, insertion of one of the rigid terminals 26,28,30 causes a slight, temporary expansion of the width of the V-shaped opening 50 as such terminal 26,28,30 is inserted in the block 24. Similarly, further insertion of one of the rigid terminals 26,28,30 into the block 24 causes a slight, temporary expansion of the width between the shoulders 56,58. Whenever one of the rigid terminals 26,28,30 first engages the shoulders 56,58, and then is inserted into the rectangular opening 60 of the partition 36, the partially resilient walls 46,48 return to their original form and the shoulders 56,58 lock such terminal 26,28,30 to the block 24. In this manner, the shoulders 56,58 lock the neck 150 which is confined within the rectangular opening 60 and, also, lock the corresponding one of the terminals 26,28,30 whenever the first arm 120 is fully inserted within the corresponding partition 36.

Figure 5:
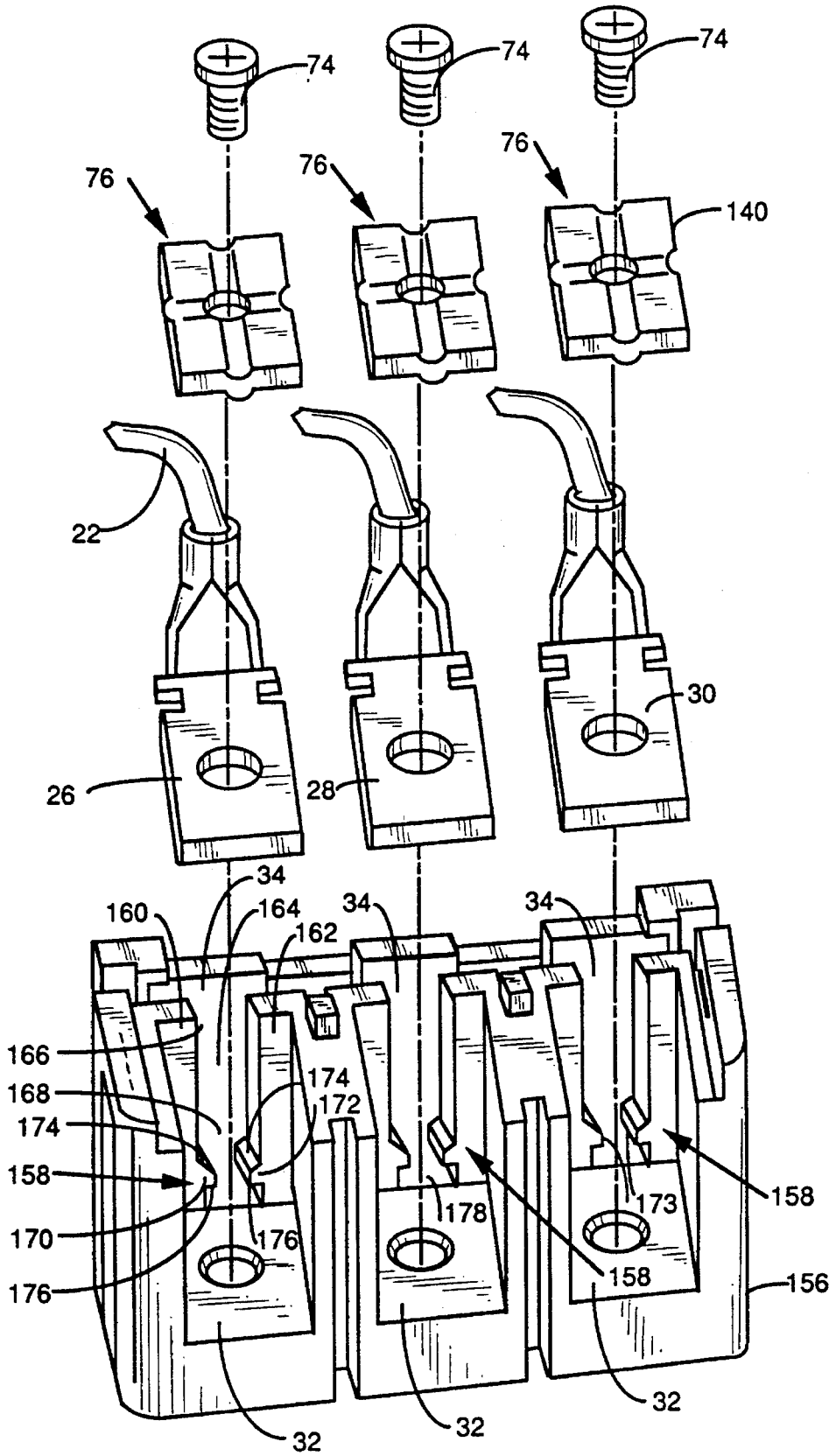
FIG. 5 is an isometric view of a block having a partition in accordance with an alternative embodiment of the invention.

FIG. 5 illustrates an isometric view of an alternative molded plastic block 156 having three partitions 158 for use with the terminals 26,28,30 of FIG. 3. For each of the terminals 26,28,30, a corresponding one of the partitions 158 partially separates the first wiring channel 32 from the second wiring channel 34. Each of the partitions 158 has two walls 160,162 which have a generally constant width therebetween. These walls 160,162 form a slot or opening 164 between the first wiring channel 32 and the second wiring channel 34. The opening 164 has an upper end 166 and a lower end 168.

Two shoulders 170,172 are respectively formed on the walls 160,162 near the lower end 168 of the opening 164. Each of the shoulders 170,172 have an upper surface 174 for engaging a corresponding one of the terminals 26,28,30 and, also, have a lower surface 176 for locking such terminal 26,28,30 to the block 156. Each of the shoulders 170,172 may be formed as a tab 173 which is generally perpendicular with respect to the two walls 160,162. Preferably, as illustrated, each of the upper surfaces 174 is oblique with respect to the walls 160, 162, in order to flex whenever the corresponding terminal 26,28,30 is inserted. The width of the neck 150 (see FIG. 3) of the terminals 26,28,30 is generally smaller than the width of the upper end 166 and the lower end 168 of the opening 164. In this manner, each of the terminals 26,28,30 is generally freely insertable within the opening 164. In contrast, the width of the neck 150 is larger than the width between the shoulders 170,172.

Each of the partitions 158 also has a rectangular opening 178 adjacent the shoulders 170,172 at the lower end 168 of the opening 164o The width of the rectangular opening 178 is wider than the width between the shoulders 170,172 and is slightly greater, or preferably equal, to the width of the neck 150 (see FIG. 3). In this manner, the shoulders 170,172 lock the neck 150 which is confined within the rectangular opening 178.

Figure 6:
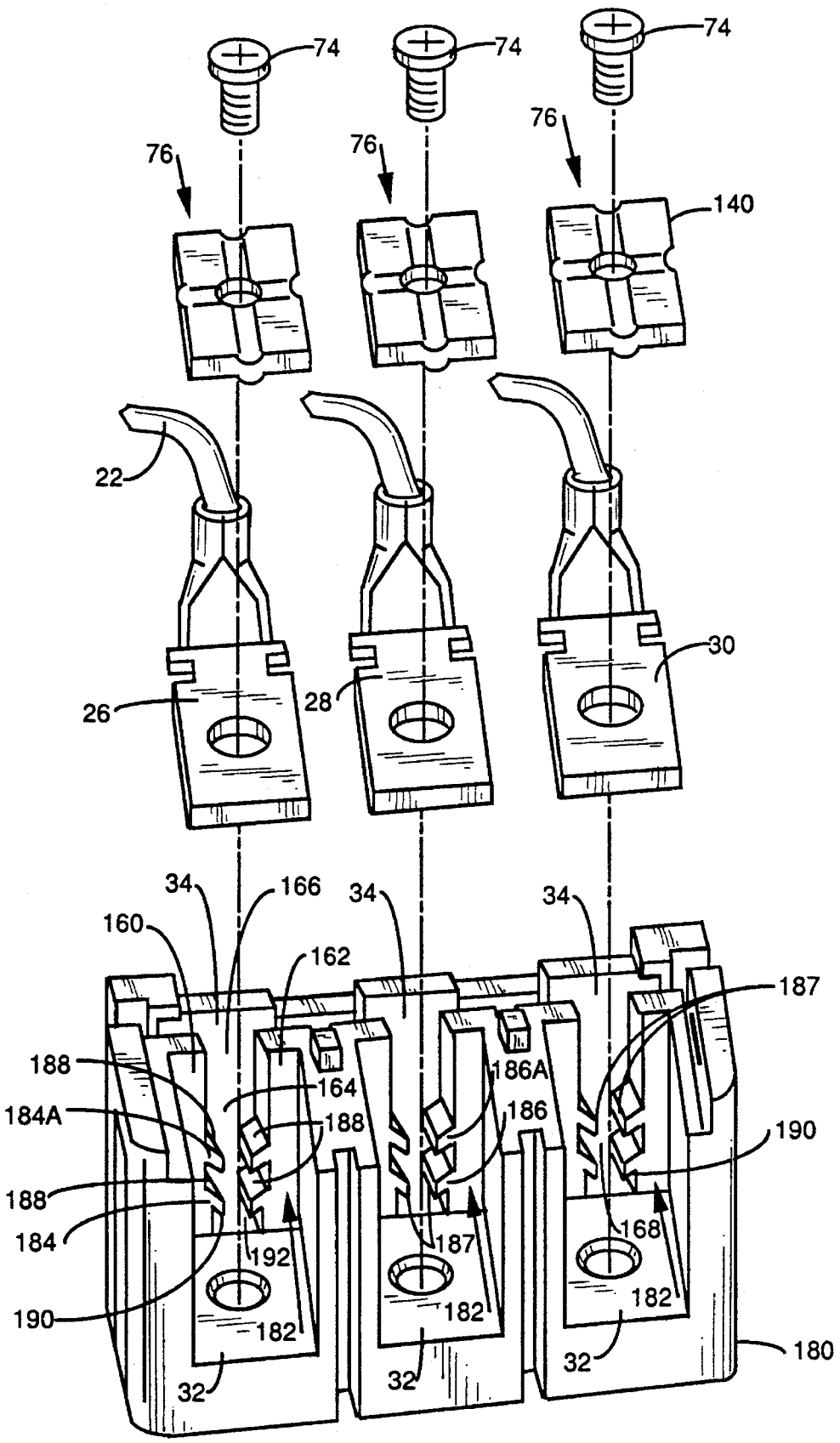
FIG. 6 is an isometric view of a block having a partition in accordance with another alternative embodiment of the invention.

FIG. 6 is an isometric view of another alternative molded plastic block 180 having three partitions 182 for use with the terminals 26,28,30 of FIG. 3. For each of the terminals 26,28,30, a corresponding partition 182 partially separates the first wiring channel 32 from the second wiring channel 34. A plurality of shoulders 184,184A,186,186A are respectively formed on the walls 160,162 near the lower end 168 of the opening 164. Each of the shoulders 184,184A,186, 186A has an upper surface 188 for engaging a corresponding one of the terminals 26,28,30. The lower shoulders 184,186 have a lower surface 190 for locking such terminal 26,28,30 to the block 180. Each of the shoulders 184,184A,186,186A is formed as a tab 187 which is generally oblique with respect to the two walls 160,162, in order to flex whenever the corresponding terminal 26,28,30 is inserted into the block 180. The width of the neck 150 (see FIG. 3) of the terminals 26,28,30 is generally smaller than the width of the upper end 166 and the lower end 168 of the opening 164. In this manner, each of the terminals 26,28,30 is generally freely insertable within the opening 164. In contrast, the width of the neck 150 is larger than the width between the shoulders 184–186, 184A–186A.

Each of the partitions 182 also has a generally rectangular opening 192 adjacent the shoulders 184, 186 at the lower end 168 of the opening 164. The width of the generally rectangular opening 192 is wider than the width between the shoulders 184–186,184A–186A and is slightly greater, or preferably equal, to the width of the neck 150 (see FIG. 3). In this manner, the shoulders 184,186 lock the neck 150 which is confined within the generally rectangular opening 192. Those skilled in the art will appreciate that other equivalent partitions are possible. For example, the shoulders 184A,186A may be eliminated. Alternatively, the shoulders 184,186 may be generally perpendicular with respect to the two walls 160, 162°.

The assembly of the terminals 26,28,30 of the exemplary auxiliary terminal block 4 may be performed outside and apart from the exemplary blocks 24,156,180 of FIGS. 2, 5 and 6. In this manner, the crimp or solder terminations are readily accessible for assembly and inspection before the terminals are inserted in the top of the blocks. This accessibility maximizes the quality of the resulting electrical connection. Furthermore, this accessibility and the elimination of a lower cover for the blocks also improves the requisite assembly time for the terminal block.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed:

1. A termination apparatus for an electrical switching device having internal wiring and accepting external wiring, said apparatus comprising:

block means for at least one wiring termination, said block means having, for each of the at least one wiring termination, a first wiring channel for accepting the external wiring, a second wiring channel for the internal wiring, and partition means for partially separating the first wiring channel and the second wiring channel; and termination means including, for each of the at least one wiring termination, first means for terminating the external wiring within the first wiring channel, second means for terminating the internal wiring within the second wiring channel, and means for interconnecting the external wiring with the internal wiring, the partition means of said block means including slot means for engaging said termination means after the internal wiring has been terminated to the second means for terminating the internal wiring.

2. The apparatus as recited in claim 1, wherein the partition means further includes locking means for locking said termination means to said block means.

3. The apparatus as recited in claim 1, wherein the partition means includes shoulder means for engaging said termination means and locking said termination means to said block means.

4. The apparatus as recited in claim 3, wherein the partition means has a first wall and a second wall, the two walls having a generally constant width therebetween, and wherein the shoulder means includes at least one tab means on each of the two walls for engaging said termination means and locking said termination means to said block means.

5. The apparatus as recited in claim 4, wherein the at least one tab means is a tab which is generally perpendicular with respect to the two walls.

6. The apparatus as recited in claim 4, wherein the at least one tab means is a tab which is generally oblique with respect to the two walls.

7. The apparatus as recited in claim 4, wherein the at least one tab means are a plurality of tabs which are generally oblique with respect to the two walls.

8. The apparatus as recited in claim 1, wherein the partition means has a first wall and a second wall, the two wails forming a generally V-shaped opening between the first wiring channel and the second wiring channel, the V-shaped opening for engaging said termination means, the two walls also forming shoulder means for locking said termination means to said block means.

9. The apparatus as recited in claim 8, wherein the generally V-shaped opening has a first end having a width and a second end having a width which is smaller than the width of the first end, and wherein the two walls of the partition means also form an opening adjacent the shoulder means for holding said termination means, the opening adjacent the shoulder means having a width which is larger than the width of the second end.

10. The apparatus as recited in claim 9, wherein said termination means has a generally L-shape and an arm resting in one of the wiring channels, the arm having on opposite sides thereof a first notch and a second notch, the first notch mating with the first wall, the second notch mating with the second wall, the two walls, the generally V-shaped opening and the two notches of the arm being oriented in a common plane.

11. The apparatus as recited in claim 10, wherein said block means is a molded block, and wherein the two walls are at least partially resilient for engaging said termination means.

12. The apparatus as recited in claim 11, wherein the two notches of the arm form a neck having a width, the width of the neck being generally smaller than the width of the first end of the generally V-shaped opening, being larger than the width of the second end of the generally V-shaped opening, and being less than or equal to the width of the :opening adjacent the shoulder means, said termination means being generally freely insertable within the first end of the generally V-shaped opening and being generally resisted by further insertion of said termination means within the generally V-shaped opening which has progressively smaller widths between the first end and the second end.

13. The apparatus as recited in claim 12, wherein the opening adjacent the shoulder means is adjacent the second end of the generally V-shaped opening, and wherein the shoulder means includes two shoulders having a width therebetween which is smaller than the width of the opening adjacent the shoulder means, in order that the two shoulders lock said termination means whenever the arm of said termination means is fully inserted within the partition means.

14. The apparatus as recited in claim 1, wherein said block means further has attachment means for attaching said apparatus to said electrical switching device and removable cover means for coveting the first wiring channel and the second wiring channel.

15. The apparatus as recited in claim 1, wherein the first means for terminating the external wiring includes an arm and screw terminal means for terminating the external wiring thereto, the arm having a tapped hole, the screw terminal means being threadably attached to the arm at the tapped hole.

16. The apparatus as recited in claim 1, wherein said termination means includes an arm within one of the wiring channels, and wherein the second means for terminating the internal wiring is a solder terminal.

17. The apparatus as recited in claim 1, wherein said termination means includes an arm within one of the wiring channels, and wherein the second means for terminating the internal wiring is a crimp terminal.

18. The apparatus as recited in claim 1, wherein said termination means includes two arms having a generally L-shape, a first arm resting in the first wiring channel, a second arm within the second wiring channel.

19. A termination apparatus for an electrical switching device having internal wiring and accepting external wiring, said apparatus comprising:

block means for at least one wiring termination, said block means having, for each of the at least one wiring termination, a first wiring channel for accepting the external wiring, a second wiring channel for the internal wiring, and partition means for partially separating the first wiring channel and the second wiring channel; and termination means including, for each of the at least one wiring termination, first means for terminating the external wiring within the first wiring channel, second means for terminating the internal wiring within the second wiring channel, and means for interconnecting the external wiring with the internal wiring, the partition means of said block means including shoulder means for engaging and locking said termination means to said block means.

20. A termination apparatus for terminating wiring thereto, said apparatus comprising:

block means for at least one wiring termination, said block means having, for each of the at least one wiring termination, a first wiring channel for accepting a first wire, a second wiring channel for a second wire, and partition means for partially separating the first wiring channel and the second wiring channel; and L-shaped termination means including, for each of the at least one wiring termination, first means for terminating the first wire within the first wiring channel, second means for terminating the second wire within the second wiring channel, and means for interconnecting the external wiring with the internal wiring, the partition means of said block means including slot means for engaging and locking said L-shaped termination means.

* * * * *